US007367900B2

(12) United States Patent
Kumamoto

(10) Patent No.: US 7,367,900 B2
(45) Date of Patent: May 6, 2008

(54) GOLF CLUB HEAD

(75) Inventor: Tomio Kumamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/846,687

(22) Filed: May 17, 2004

(65) Prior Publication Data

US 2005/0020379 A1 Jan. 27, 2005

(30) Foreign Application Priority Data

May 30, 2003 (JP) ..... 2003-155093

(51) Int. Cl.
*A63B 53/04* (2006.01)

(52) U.S. Cl. ..... 473/345; 473/348

(58) Field of Classification Search ..... 473/324–350
See application file for complete search history.

(56) References Cited

U.S. PATENT DOCUMENTS

| | | | | |
|---|---|---|---|---|
| 4,984,800 | A * | 1/1991 | Hamada | 473/346 |
| 5,393,362 | A * | 2/1995 | Culler | 156/153 |
| 5,681,228 | A * | 10/1997 | Mikame et al. | 473/330 |
| 6,344,002 | B1 * | 2/2002 | Kajita | 473/330 |
| 6,364,789 | B1 * | 4/2002 | Kosmatka | 473/329 |
| 6,435,978 | B1 * | 8/2002 | Galloway et al. | 473/305 |
| 6,582,323 | B2 * | 6/2003 | Soracco et al. | 473/342 |
| 6,623,378 | B2 * | 9/2003 | Beach et al. | 473/345 |
| 6,672,975 | B1 * | 1/2004 | Galloway | 473/342 |
| 6,676,535 | B2 * | 1/2004 | Sheets et al. | 473/328 |
| 2005/0233830 | A1 * | 10/2005 | Williams | 473/342 |

FOREIGN PATENT DOCUMENTS

| | | | |
|---|---|---|---|
| JP | 11-137734 | A | 5/1999 |
| JP | 11-169493 | A | 6/1999 |
| JP | 2001-190719 | A | 7/2001 |
| JP | 2002-17913 | A | 1/2002 |
| JP | 2002-58762 | A | 2/2002 |

OTHER PUBLICATIONS

"Polyurethane", Efunda.com.*

* cited by examiner

*Primary Examiner*—Alvin A. Hunter, Jr.
(74) *Attorney, Agent, or Firm*—Birch, Stewart, Kolasch & Birch, LLP

(57) ABSTRACT

A hollow golf club head containing a face component made of a metal material and including a face plate forming a face portion of the head and a turnback extending backward from the face plate; a FRP component made of a fiber reinforced resin; and an elastomeric insert made of an elastomeric material disposed between the turnback and the FRP component.

2 Claims, 12 Drawing Sheets

GOLF CLUB HEAD

This Nonprovisional application claims priority under 35 U.S.C. § 119(a) on Patent Application No(s). 2003-155093 filed in JAPAN on May 30, 2003, the entire contents of which are hereby incorporated by reference.

BACKGROUND OF THE INVENTION

The present invention relates to a golf club head, more particularly to a hybrid structure of a metal component and a fiber reinforced plastic component being capable of generating a favorable high-pitched hitting sound.

In case of wood-type golf clubs in particular, metal heads made of one or more kinds of metal materials are nowadays widely used. In this type of club head, there is a strong tendency towards a very large head volume, adopting a hollow structure. A hollow metal head having a relatively large head volume can generate a high-pitched ball hitting sound which gives a favorable hitting impression to many golfers, and thus this is one of the reasons for the preference of the large-sided metal heads.

In this type of head, however, it is very difficult to lower the center of gravity while maintaining a large head volume because the design freedom of weight distribution is small due to the limited overall weight and large volume.

On the other hand, golf club heads made of fiber reinforced plastic (FRP) have been proposed. In case of such all-FRP club heads, however, although the design freedom may be increased, in comparison with all-metal head, the hitting sound becomes lower in the peak sound pressure frequency, and thus the hit feeling is not desirable for many golfers. Further, the rebound performance and durability are inferior to all-metal head.

SUMMARY OF THE INVENTION

It is therefore, an object of the present invention to provide a golf club head whose hitting sound is rendered to be a high-pitched sound from which a good hit feeling can be obtained, without sacrificing durability, and while increasing the design freedom of weight distribution for a large-sized head.

According to the present invention, a golf club head comprises:

a face portion whose front face defines a club face;

a hollow behind the face portion;

a face component made of a metal material and including a face plate forming at least a part of the face portion, and a turnback portion extending backward from the face plate;

a FRP component made of a fiber reinforced resin; and an elastomeric insert made of an elastomeric material disposed between the turnback portion and the FRP component.

BRIEF DESCRIPTION OF THE DRAWINGS

The present invention will become more fully understood from the detailed description given hereinbelow and the accompanying drawings, which are given by illustration only, and thus are not limitative of the present invention, and wherein.

DESCRIPTION OF THE PREFERRED EMBODIMENTS

Embodiments of the present invention will now be described in detail in conjunction with the accompanying drawings.

In the following embodiments, club head 1 according to the present invention is a wood-type hollow club head (#1 driver). A hollow structure is preferable to a filled structure with an expanded plastic or the like because a relatively long reverberation time can be obtained.

Figure 1:
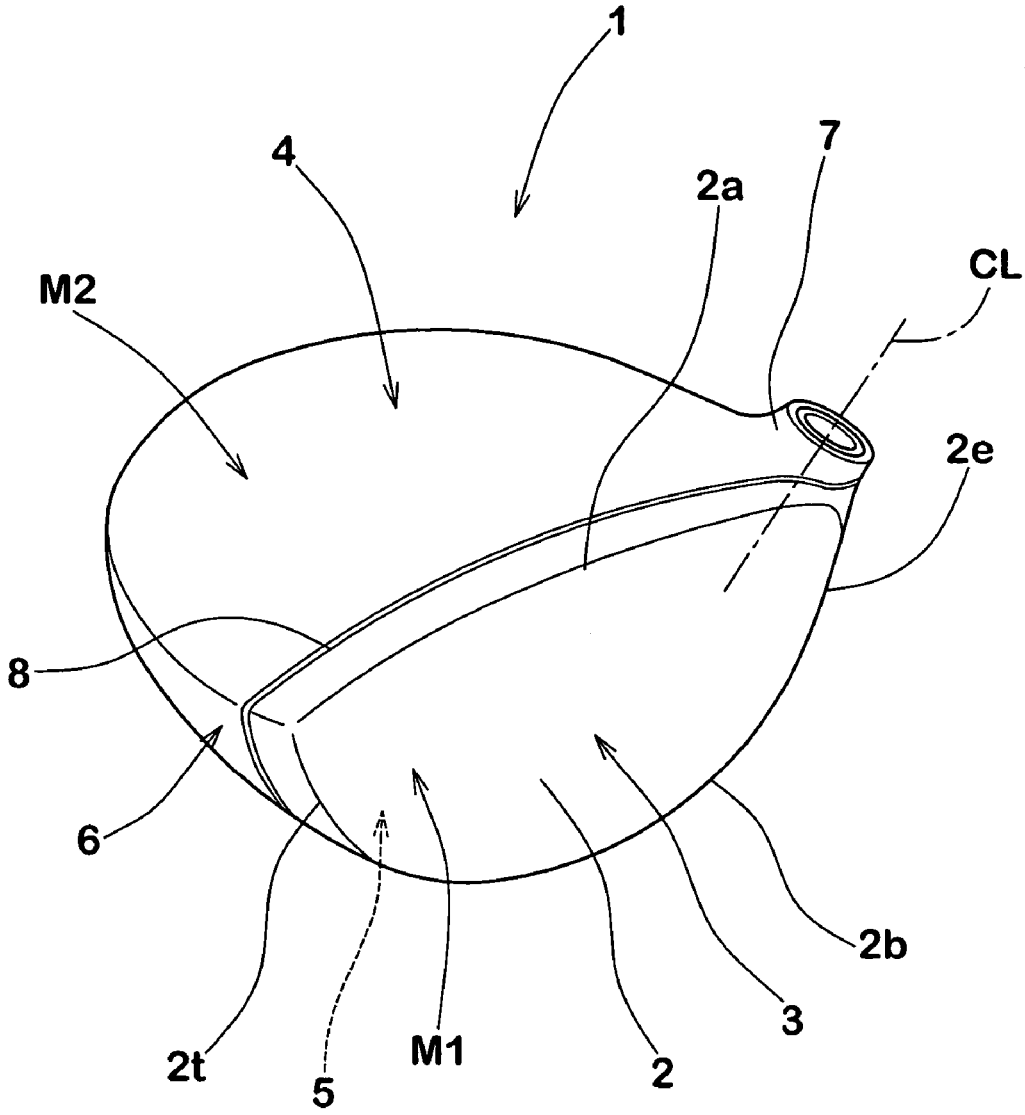
FIG. 1 is a perspective view of a wood-type golf club head according to the present invention showing an exemplary outer shape thereof.
Figure 2:
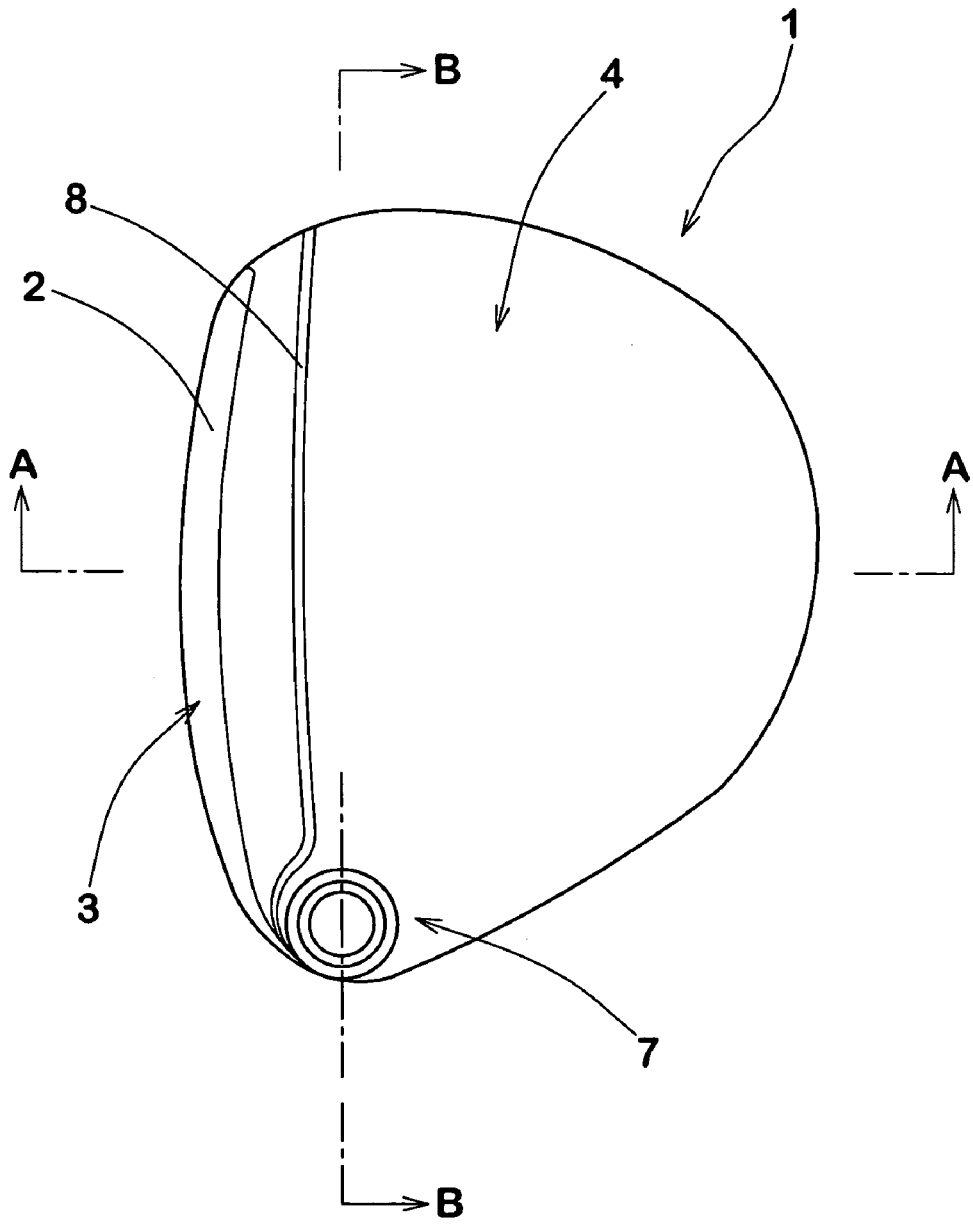
FIG. 2 is a top view thereof.
Figure 3:
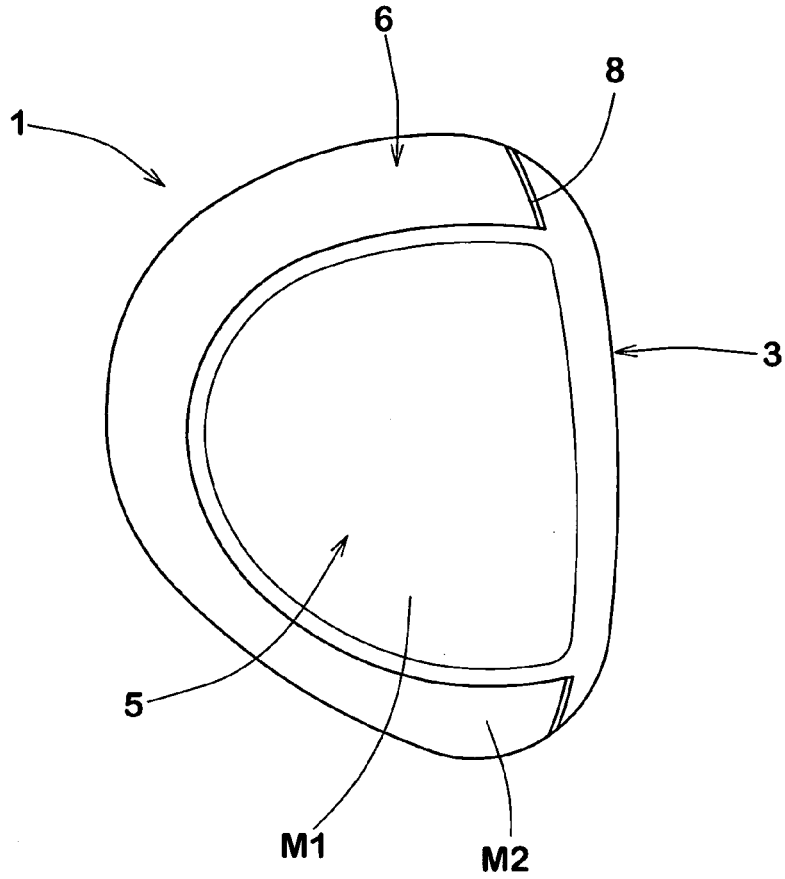
FIG. 3 is a bottom view thereof.

AS shown in FIGS. 1, 2 and 3, the golf club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*t* to a heel-side edge 2*e* of the club face 2 through the back face of the club head; a hosel neck portion 7 to be attached to an end of a club shaft (not shown); and a hollow (i) immediately behind the face portion 3.

In case of a wood-type club head, the head volume is set in the range of not less than 300 cc, preferably more than 350 cc, more preferably more than 380 cc, more preferably more than 400 cc, but not more than 600 cc, preferably less than 500 cc. Such a large head volume is preferred from a point of view of performance advantage as well as improvement in the hitting sound because high frequency components of the hitting sound can be enhanced and the decay time thereof is prolonged.

According to the present invention, the club head 1 is made up of at least a face component M1 made of a metal material, an FRP component M2 made of a fiber reinforced resin and an elastomeric insert 8.

Figure 5:
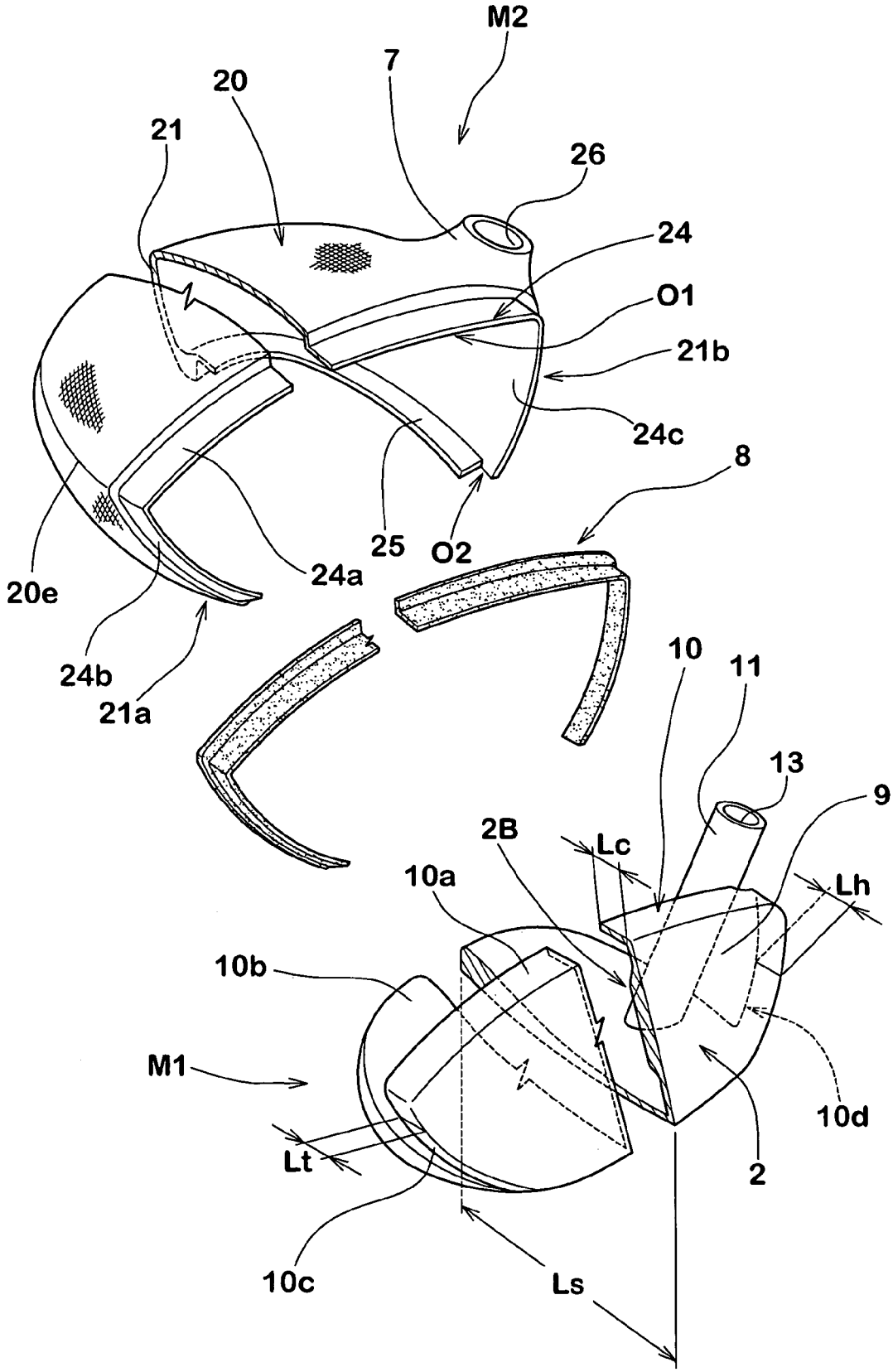
FIG. 5 is an exploded perspective view of the club head showing an example of three-piece structure.
Figure 7:
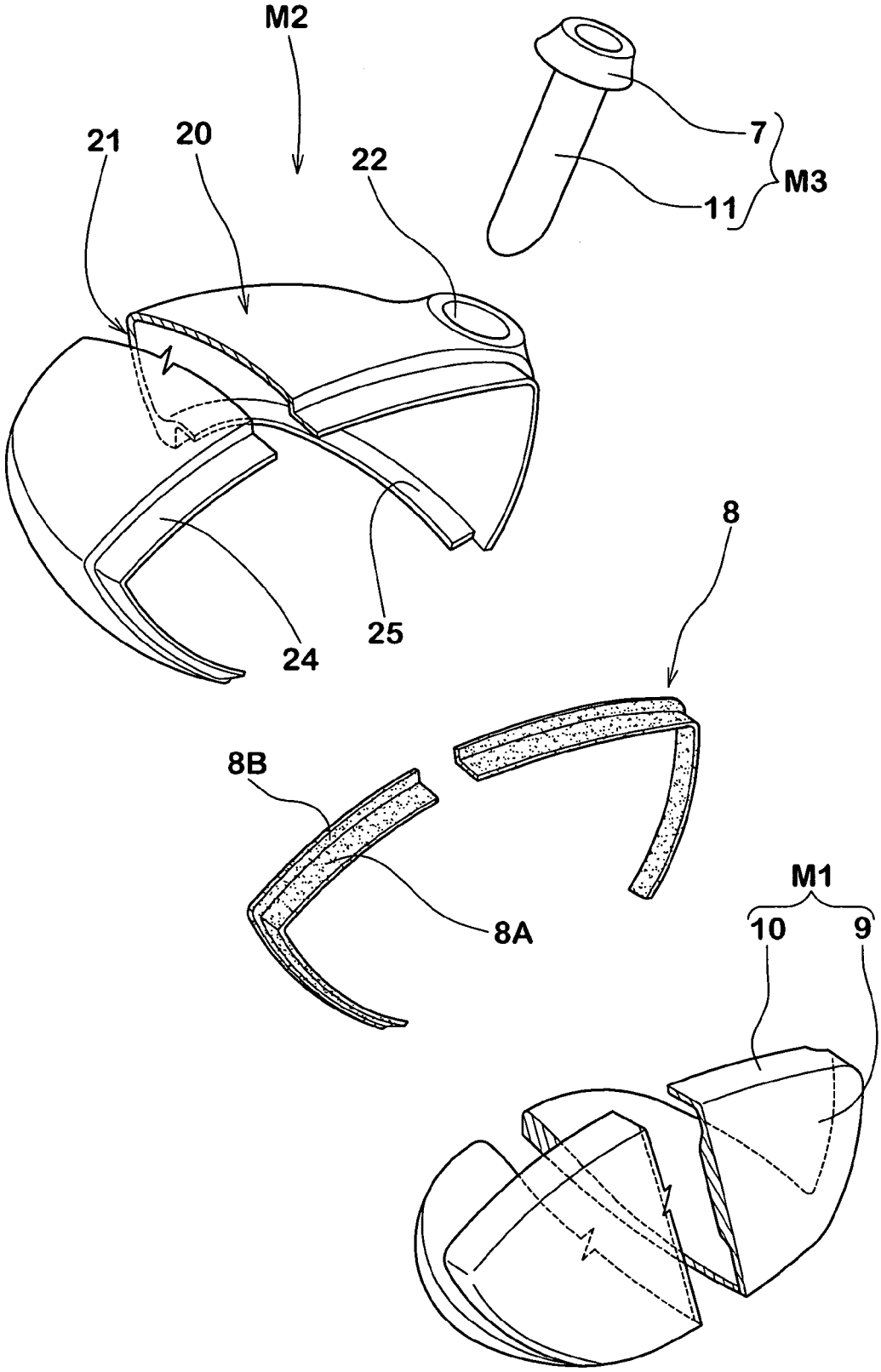
FIG. 7 is an exploded perspective view of the club head showing a four-piece structure.

FIG. 5 shows a structure made up of the above-mentioned minimum parts M1, M2 and 8. FIG. 7 shows a four-piece structure comprising these three parts and an additional part M3.

Figure 6:
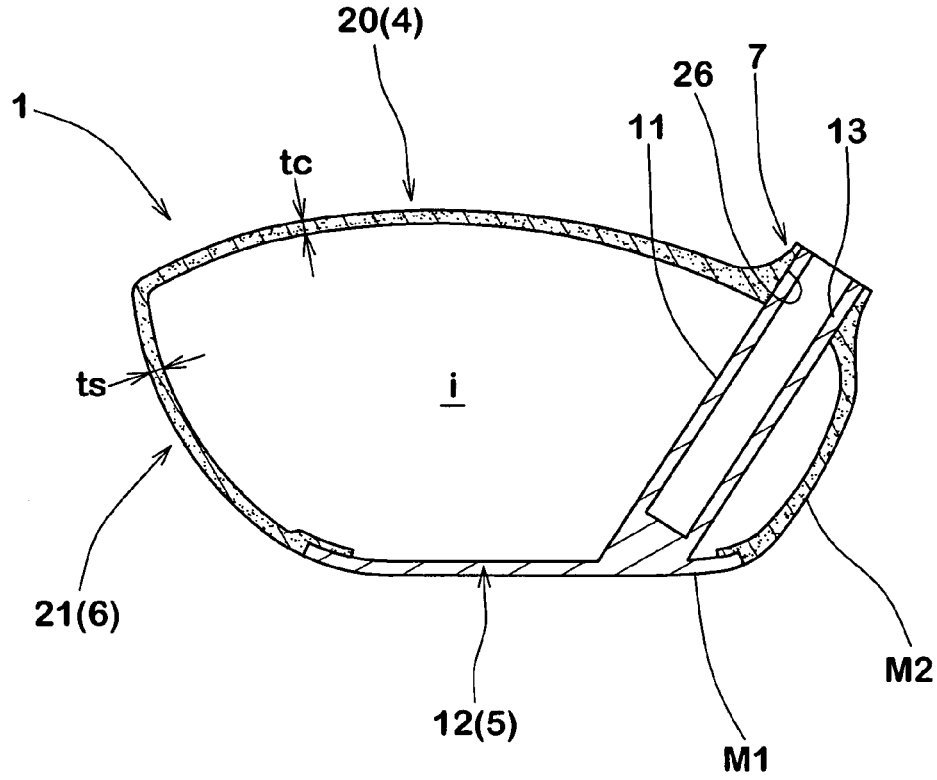
FIG. 6 is a cross sectional view taken along line B-B in FIG. 2 showing the hosel portion in the above-mentioned three-piece structure.
Figure 8:
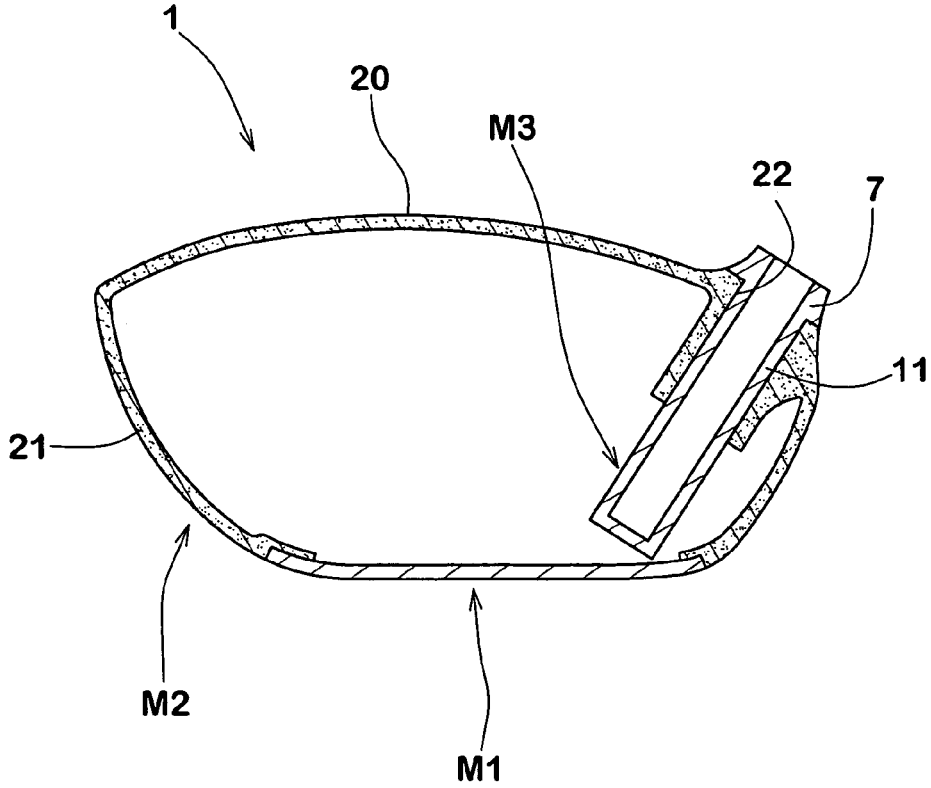
FIG. 8 is a cross sectional view taken along line B-B in FIG. 2 showing the hosel portion in the above-mentioned four-piece structure.

Firstly, the example show in FIGS. 5 and 6 is descried mainly but interweaving with the example show in FIGS. 7 and 8.

The face component M1 comprises a face plate 9 and a turnback 10 extending backward from the edge (at least an upper edge) of the face plate 9.

The face plate 9 forms at least a major portion (preferably more than 80% in area) of the club face 2 so as to include the sweet spot. The face plate 9 in this example forms the entirety of the club face 2.

Figure 4:
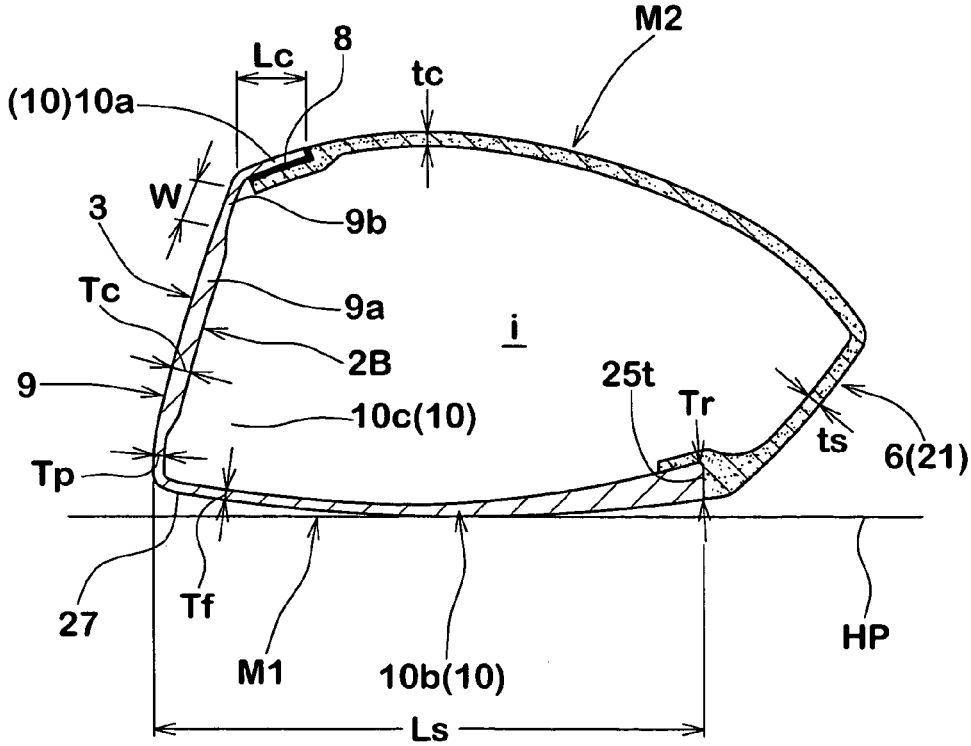
FIG. 4 is a cross sectional view of the head taken along line A-A in FIG. 2.

The optimum thickness for the face plate 9 may be somewhat varied depending on the metal material used, but in most case, it is preferable that the thickness is set in a range of from 2.0 mm to 3.0 mm. The thickness may be a substantially constant value throughout the face portion 3, but in this example, the face portion 3 has a variable thickness such that a central region 9*a* including the sweet spot is surrounded by a thinner peripheral zone 9*b* as shown in FIG. 4. The thickness Tc of the central region 9*a* is set in the range of not less than 2.5 mm, preferably more than 2.7 mm, but not more than 3.0 mm, preferably less than 2.9 mm. The thickness Tp of the peripheral zone 9*b* is set in the range of not less than 2.0 mm, but not more than 2.5 mm, preferably less than 2.3 mm. The width w of the peripheral zone 9*b* is determined such that the area of the peripheral zone 9*b* is in the range of from 20 to 50% of the area of the central region 9*a*.

The face plate 9 provided with such thinner peripheral zone 9*b* can increase the flexural deformation of the face portion 3, and improve the rebound performance, while providing an impact strength and durability.

The above-mentioned turnback 10 includes at least an upper turnback 10*a*, and in this example further includes a lower turnback 10*b*, a toe-side turnback 10*c* and a heel-side turnback 10*d*. In this example, therefore, the turnback 10 as a whole extends continuously around the face plate 9.

The upper turnback 10*a* extends backward from the upper edge (2*a*) of the face plate 9 to form a front end zone of the crown portion 4. The toe-side turnback 10*c* extends backwards from the toe-side edge (2*t*) of the face plate 9 and forms a front end zone of the side portion 6 on the toe-side. The heel-side turnback 10*d* extends backwards from the heel-side edge (2*e*) of the face plate 9 and forms a front end zone of the side portion 6 on the heel-side. The lower turnback 10*b* extends backward from the lower edge (2*b*) of the face plate 9 and forms at least a front end zone of the sole portion 5.

As to the amount of backward extension of the turnback (hereinafter, the "backward length"), in this embodiment, the backward length Lc of the upper turnback 10*a*, the backward length Lt of the toe-side turnback 10*c* and the backward length Lh of the heel-side turnback 10*d* are substantially same values along the edges 2*a*, 2*t* and 2*e*. But the backward length Ls of the lower turnback 10*b* is more than the backward length Lc, Lt and Lh. As the lower turnback 10*b* extends backward in a significantly larger amount, unlike the upper, toe-side and heel-side turnback, the lower turnback 10*b* forms not less than 60%, preferably not less than 80% (in this example 100%) in area of the sole portion 5. Furthermore, it is also possible that the lower turnback 10*b* forms more than 100% of the sole portion 5. This means that the lower turnback 10*b* forms a lower part of the side portion 6. Therefore, the sole portion 5 of the head can be improved in the resistance to external injury and durability, while lowering the center of gravity G.

In this example, further, in order to deepen the center of gravity, the lower turnback 10*b* gradually increases in thickness from its front end to rear end as shown in FIG. 4 and FIG. 5. In case of the lower turnback 10*b* being substantially 100% of the sole portion 5, it is preferable for optimizing strength and weight balance that: the minimum thickness Tf in the front end zone is set in the range of not less than 1.0 mm, preferably more than 1.5 mm, but not more than 3.0 mm, preferably less than 2.5 mm; and the maximum thickness Tr in the rear end zone is set in the range of not less than 2.0 mm, preferably more than 2.5 mm, but not more than 8.0 mm, preferably less than 6.0 mm.

In FIG. 5 example, the face component M1 further comprises a hosel tubular portion 11 extending obliquely from the lower turnback 10*b* in one body. The hosel tubular portion 11 into which a club shaft is inserted, has a hole 13 opened at the upper end and having a circular cross sectional shape. In case of FIG. 7 example, however, the hosel tubular portion 11 is not provided.

The face component M1 is preferably formed as a casting of a metal material. However, it may be also possible to make the face component M1 by assembling two or more parts formed by casting, forging, pressing, rolling, cutting or the like and joining them by welding and the like.

As to the metal material for the face component M1, various materials, e.g. titanium alloys, pure titanium, aluminum alloys, stainless steel and the like may be used. But, titanium alloys having a high specific tensile strength are preferably used. Especially, alpha and beta titanium alloys such as Ti-6Al-4V, Ti-4.5Al-3V-2Fe-2Mo and Ti-2Mo-1.6V-0.5Fe-4.5Al-0.3Si-0.03C, and beta titanium alloys such as Ti-15V-3Cr-3Al-3Sn, Ti-15Mo-5Zr-3Al, Ti-15Mo-5Zr-4Al-4V, Ti-15V-6Cr-4Al and Ti-20V-4Al-1Sn are preferred.

In this example, the face component M1 is formed as a casing of Ti-6Al-4V, an alpha and beta titanium alloy suitable for casting, using a lost-wax precision casting method.

The above-mentioned FRP component M2 comprises: a major crown portion 20 which forms the crown portion 4 together with the upper turnback 10*a*; and a major side portion 21 which extends from its toe-side edge 21*a* to heel-side edge 21*b* through the back face and forms the side portion 6 together with the toe-side turnback 10*c* and heel-side turnback 10*d*; and in the case of the example shown in FIGS. 5 and 6, further includes the hosel neck portion 7. Therefore, the FRP part M2 has an opening (front part O1 and bottom part O2) extending from the front to the bottom of the head.

The FRP component M2 is provided with an overhang 24 and an overhang 25 along the edge of the front part O1 and bottom part O2 of the opening.

The overhang 25 is disposed near the lower end of the major side portion 21 to overlap with the lower turnback 10*b* on the inside of the head.

The overhang 24 is disposed at the front end of the major crown portion 20 and major side portion 21 to overlap with the turnback 10*a*, 10*c*, 10*d* on the inside of the head.

The overhang 24 in this example is made up of a crown-side overhang 24*a*, a toe-side overhang 24*b* and a heel-side overhang 24*c*, and thus the overhang 24 extends continuously from the toe to the heel. It is however, possible to form discontinuously as one of modifications.

Figure 9:
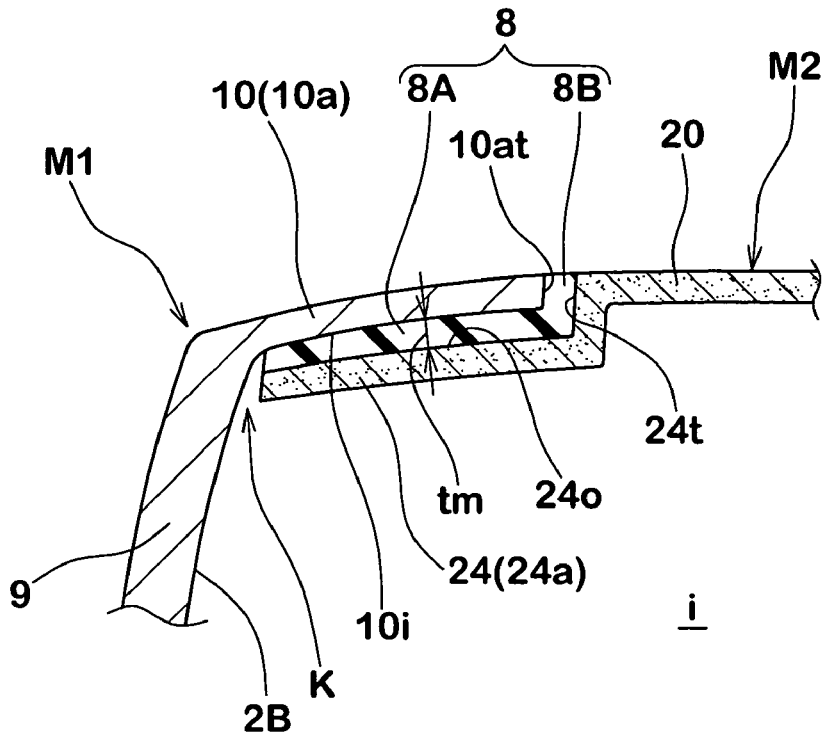
FIG. 9 is an enlarged cross sectional view of the joint portion between the face component and FRP component showing a joint structure.

As shown in FIGS. 4 and 9, the overhang 24 recedes from the outer surface of the club head through a step 24*t* by an amount equal to the sum of the thickness of the turnback 10 to be overlapped and the thickness of the elastomeric insert 8 compressed therebetween. Also the overhang 25 recedes from the outer surface of the club head through a step 25*t* by an amount equal to the thickness of the lower turnback 10*b* to be overlapped.

In order for obtaining a high-pitched hitting sound at impact, it is important to make the major crown portion 20 to vibrate easily. Therefore, the thickness (tc) of the major crown portion 20 is set in the range of not more than 2.0 mm, preferably less than 1.5 mm, but not less than 0.3 mm, preferably more than 0.5 mm, more preferably more than 1.0 mm.

If the thickness (tc) is less than 0.3 mm, it is difficult to obtain necessary strength and durability for the major crown portion 20. If the thickness (tc) is more than 2.0 mm, the major crown portion 20 becomes difficult to vibrate at impact, and thus it is difficult to obtain high-pitched hitting sound. Further, it is not preferable as the weight increases in the upper part of the club head.

The thickness (ts) of the major side portion 21 is set in the range of not less than 0.3 mm, preferably more than 1.0 mm, but not more than 8.0 mm, preferably less than 5.0 mm.

If the thickness (ts) is less than 0.3 mm, the strength decreases, and the directional stability is liable to deteriorate. If the thickness (ts) is more than 8.0 mm, as the weight increases although the total weight of the club head is limited, it becomes difficult to reallocate a weight to a lower portion such as sole portion in order to lower the center of gravity. Further, the vibration is resisted.

In FIG. 5, the above-mentioned hosel neck portion 7 is provided with a hole 26 into which the hosel tubular portion 11 is inserted from the inside of the head. The upper end of the inserted hosel tubular portion 11 becomes flush with the upper end of the hosel neck portion 7 when inserted.

In this embodiment, the FRP component M2 is manufactured at once by integral moulding. But, multi-stage methods, for example, firstly making two or more discrete parts and then joining these parts together for example using adhesive agent or the like, can be employed to manufacture the FRP component M2.

Figure 15A:
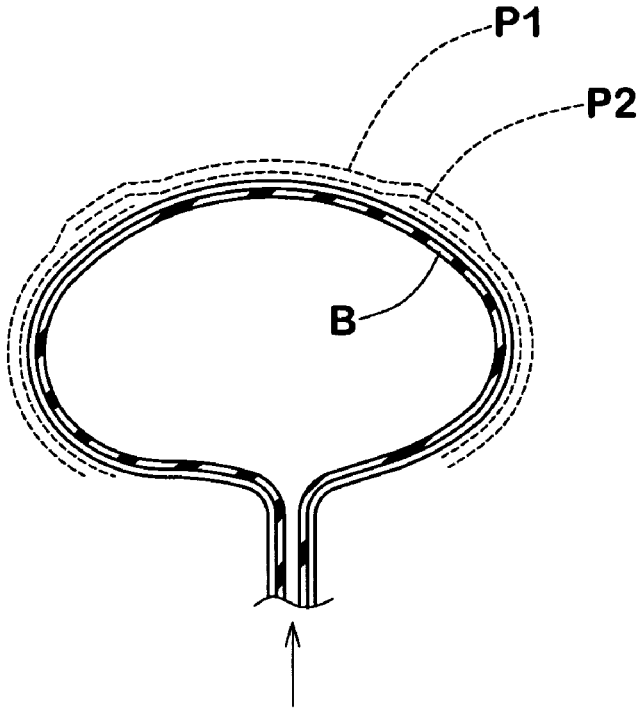
FIGS. 15(*a*) and 15(*b*) are schematic cross sectional views for explaining a method of manufacturing the FRP component.
Figure 15B:
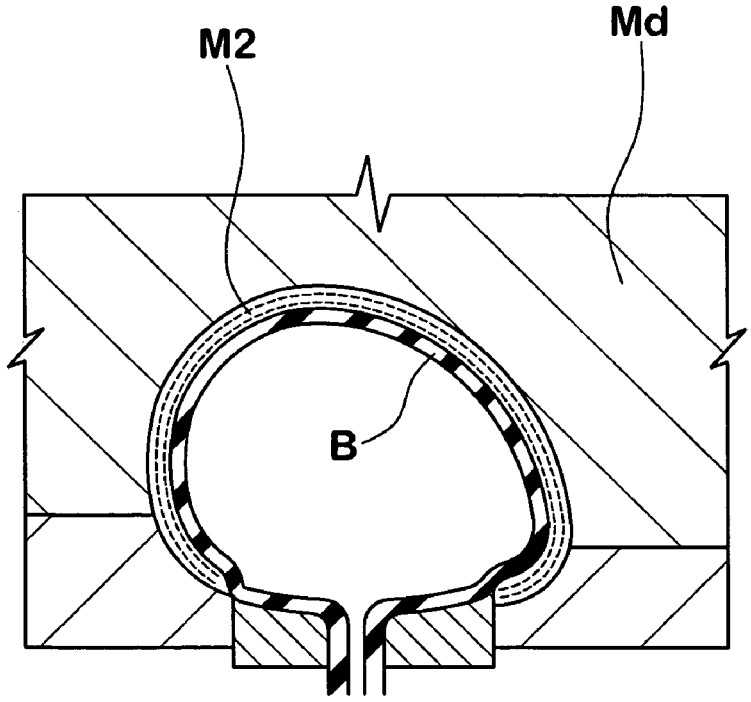

FIG. 15(*a*) shows an example of the integral moulding method, wherein an inflatable bladder B, some pieces of prepreg P(P1, P2 —) and a mold Md are used. Prepreg pieces P1, P2—cut into appropriate shapes are applied to the surface of the substantially inflated bladder B. The number of layers of the laminated pieces is determined to satisfy the requirements for the thickness of the FRP component M2. The prepreg is as well known in the art, fiber reinforced resin sheet formed by impregnating a thermosetting resin with woven fabric of fibers, or unwoven fabric in which fibers are oriented in one direction, or unwoven fabric in which short fibers are dispersed at random directions. In case of prepreg of unidirectional orientation, prepreg pieces are applied so that the reinforcing fibers cross each other between the adjacent prepreg pieces.

As shown in FIG. 15(*b*), the laminate of the prepreg pieces, together with the bladder B, is put into the mold Md, and the bladder B is fully inflated to press the laminate against the inner surface of the mold Md which mold is heated up to a curing temperature of the thermosetting resin, and it is heated for a given length of time. Then, after the resin is hardened, the bladder is deflated and the prepreg pieces are demolded, and unnecessary part is trimmed if any.

The thermosetting resin is, for example, epoxide resin, nylon resin or the like. It is preferable that the amount of resin is in the range of 20 to 30% of the overall weight.

As to the reinforcing fibers, organic fibers such as carbon fibers and aramid fibers, having a modulus of elasticity of not less than 200 GPa, preferably not less than 240 GPa, more preferably not less than 290 GPa, but preferably not more than 500 GPa, are preferably used. Specifically, the following carbon fibers may be preferably used.

TABLE 1

| | | Modulus of elasticity | |
|---|---|---|---|
| Manufacturer | Symbol | ton/sq · mm | GPa |
| Mitsubishi Rayon Co., Ltd. | TR50S | 24.5 | 240.3 |
| | MR40 | 30 | 294.2 |
| | HR40 | 40 | 392.3 |
| Toray Industries, Inc. | T700S | 23.5 | 230.5 |
| | T300 | 23.5 | 230.5 |
| | T800H | 30 | 294.2 |
| | M30SC | 30 | 294.2 |
| | M40J | 38.5 | 377.6 |
| | M46J | 46 | 451.1 |
| Toho Tenax Co., Ltd. | UT500 | 24.5 | 240.3 |
| | HTA | 24 | 235.4 |
| | IM400 | 30 | 294.2 |
| Nippon Graphite Fiber Corporation | YS-80 | 80 | 784.5 |

The modulus of elasticity of carbon fibers was measured according to Japanese Industrial Standard R7601:1986, "Testing method for Carbon fibers".

Aside from the above-mentioned prepreg molding, other manufacturing methods such as injection molding may be employed. In this case, by mixing short fibers with the injected resinous material, random orientation may be obtained. If the fibers are disposed in the mold in advance, an ordered fiber arrangement may be obtained.

In the example shown in FIG. 7, on the other hand, the face component M1 is the same as that shown in FIG. 5 except that the hosel tubular portion 11 is excluded. Namely, the face component M1 is made up of the above-explained face plate 9 and turnback 10. The FRP component M2 is the same as that shown in FIG. 5 except that the hosel neck portion 7 is excluded. Namely, in comparison with that shown in FIG. 5, the crown portion is formed relatively flat on the heel side, and a through hole 22 is provided to insert the fourth part M3.

The above-mentioned additional fourth part M3 is made up of the excluded hosel neck portion 7 and hosel tubular portion 11 (hereinafter the "hosel component M3"). The hosel component M3 is formed by casting in the same way as the face component M1, but it is of course possible to make it by another method such as lathing.

The above-mentioned elastomeric insert 8 is made of an elastomeric material and disposed at least between the upper turnback 10*a* of the face component M1 and the FRP component M1.

If the hardness of the elastomeric insert 8 is too small, the amplitude of impulsive force applied to the FRP component M2 from the face component M1 increases, and the durability is liable to deteriorate. If the hardness is too large, the vibration of the face plate at impact is controlled and it becomes difficult to obtain the high-pitched hitting sound. Further, the durability is liable to deteriorate.

Preferably, the shore-A hardness of the elastomeric material is set in the range of not more than 80, preferably less than 70, more preferably less than 60, still more preferably less than 50, but not less than 30, preferably more than 35.

For example, polymer alloy of esters polymer(s) and halogen polymer(s), styrene block copolymer, block copolymer of polystyrene and vinyl polyisoprene, chlorinated polyethylene, acrylonitrile-butadiene rubber (NBA), acrylic rubber (ACR), styrene-butadiene rubber (SBR), chloroprene rubber (CR), norbornene-based polymer and the like may be used.

In this example, the elastomeric insert 8 is disposed between the overhang 24 and the upper, toe-side and heel-side turnback 10*a*, 10*c* and 10*d*.

In the example shown in FIGS. 5, 7 and 9, the elastomeric insert 8 has an L-shaped cross sectional shape made up of a main portion 8A and a perpendicular portion 8B at the rear end of the main portion 8A.

The main portion 8A is sandwiched between the inner surface 10*i* of the turnback 10(10*a*) and the outer surface 24*o* of the overhang 24. Between the rear end 10 at of the turnback 10 and a step 24*t* at the rear end of the overhang 24, the perpendicular portion 8B extends to and flushes with the surface of the club head. Between the front end of the overhang 24 and the back side 2B of the face plate, a small space K is left to allow a relative displacement of the face component M1 towards the FRP component M2 at impact.

If the thickness of the main portion 8A is too small, the amplitude of impulsive force received by the FRP component M2 from the face component M1 increases, and the durability is liable to deteriorate. Further, the vibration of the face plate due to impact is liable to be damped. If the thickness is too large, the durability of the junction is again liable to deteriorate, and also in view of the weight increase it is not preferable. Therefore, the thickness (tm) of the main portion 8A is set in the range of not less than 0.8 mm, preferably more than 1.0 mm, more preferably more than 1.2 mm, but not more than 5.0 mm, preferably less than 3.0 mm, more preferably less than 2.0 mm. Also, the thickness of the perpendicular portion 8B is set in the same range as above.

In the example shown in FIG. 9, the width of the main portion 8A is the substantially same as the above-mentioned backward length Lc of the turnback 10.

If the backward length Lc of the upper turnback 10*a* is too small or too large, then the vibration is controlled and it becomes difficult to generate a high-pitched hitting sound.

Thus, the length Lc is set in the range of not less than 4.0 mm, preferably more than 6.0 mm, more preferably more than 8.0 mm, but not more than 30 mm, preferably less than 25.0 mm, more preferably less than 12.0 mm.

In this example, between the lower turnback 10*b* and the overhang 25 around the bottom opening part O2, the elastomeric insert 8 is not disposed, and they are directly joined with an adhesive. But, it is also possible to dispose the elastomeric insert 8 therebetween.

In assembling the head, the lower turnback 10*b* is placed to close the bottom opening O2, and the lower turnback 10*b* and the overhang 25 are joined with an adhesive agent.

In case of FIG. 6 example, the hosel tubular portion 11 is inserted into the above-mentioned hole 26 from the inside of the FRP component M2, and the upper end portion of the hosel tubular portion 11 is fixed to the inner surface of the hole 26 using an adhesive agent.

The face plate 9 is placed so as to close the front opening O1, with the elastomeric insert 8 disposed between the turnback 10 and overhang 24. Using an adhesive agent between the elastomeric insert 8 and the turnback and between the elastomeric insert 8 and the overhang, they are joined.

As to the adhesive agents, for example, epoxy adhesive, polyurethane adhesive, rubber-based adhesive and the like may be used. In this example, epoxy adhesive used.

In order to increase the adhesive strength, it is preferable that surface roughening is made on the bonding face of the turnback 10 especially upper turnback 10*a* by shot blast, shot peening or the like. Preferably, the roughness of the roughened surface R is in the range of not less than 10 micrometers, preferably more than 15 micrometers, but not more than 40 micrometers, preferably less than 35 micrometers. In general, the roughness of the casting surface of a lost-wax precision casting is less than 10 micrometers. Here, the roughness means the "ten point height of roughness profile" measured according to the Japanese Industrial Standard B0601 (ISO 4287).

Figure 17:
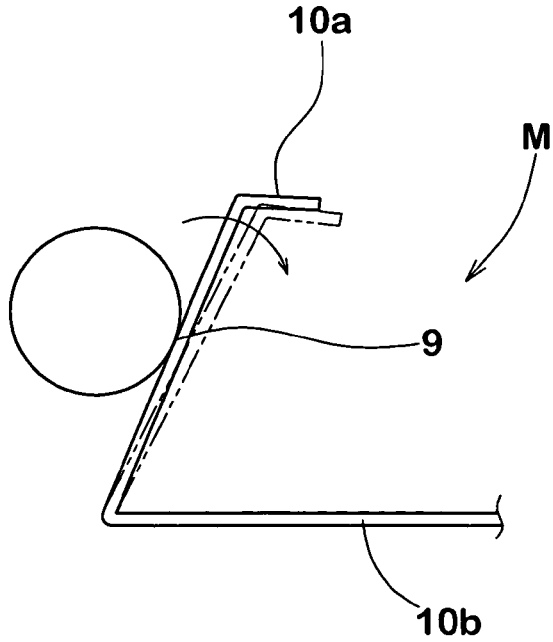
FIG. 17 is a diagram for explaining deformation of the face component at impact.

The elastomeric insert 8 allows the face plate 9 to lean back at impact as shown in FIG. 17 with exaggeration. Thereby, the loft angle at impact is increased to increase the launching angle of the ball. There is more, the vibration of the metallic face plate at impact is promoted or not hindered by the major crown portion 20 of the FRP component M1, and the reverberation can be prolonged. Thus, it becomes not necessary to decrease the thickness of the crown portion 20 to excess in order to provide a flexible support for the face plate.

Especially preferably, by decreasing the thickness of the major crown portion 20 in a range of 0.4 to 0.8 mm, using high modulus fibers having a modulus of elasticity of not less than 230 GPa preferably in a range of from 300 to 500 GPa, not only the crown portion 4 but also the face portion become liable to vibrate at impact and heightening of the hitting sound can be promoted.

In anyway, it is preferable that the maximum sound pressure level occurs within a frequency band of not less than 4000 Hz, preferably more than 4500 Hz, but not more than 7000 Hz, preferably less than 6000 Hz. The frequency can be changed by adjusting the shore-A hardness, thickness and width of the insert 8. Further, through the use of increased design freedom, it is proffered to design the head as follows.

In order to increase the sweet area, the depth of the center of gravity is preferably set in the range of not less than 40 mm, preferably more than 42 mm, more preferably more than 45 mm, but not more than 55 mm, preferably less than 50 mm.

Further, in order to have greater vertical gear effect, the sweet spot height is set in the range of not more than 30 mm, preferably less than 25 mm, more preferably less than 20 mm, but not less than 15 mm.

In case of all-metal club head having a head volume of more than 300 cc, it is very difficult to achieve the above-mentioned deep gravity point and low sweet spot while maintaining the satisfactory durability. However, according to the present invention, it can be easily achieved.

Furthermore, it is preferable that the restitution coefficient (e) is set in the range of not less than 0.800, preferably more than 0.820, but not more than 0.860, preferably less than 0.850. Here, the restitution coefficient (e) is measured according to the "Procedure for Measuring the Velocity Ratio of a Club Head for Conformance to Rule 4-1e, Appendix II, Revision 2 (Feb. 8, 1999), United States Golf Association".

Figure 10:
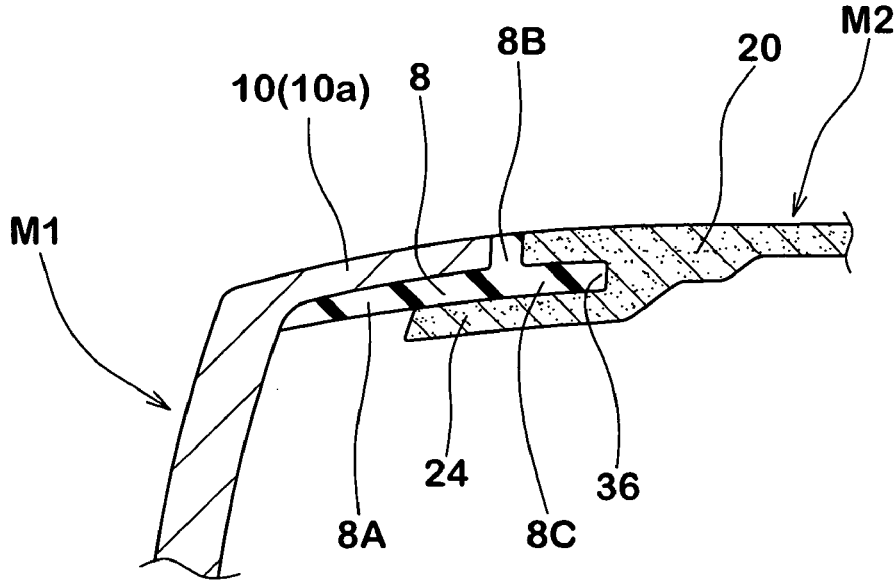
FIGS. 10 and 11 are enlarged cross sectional views each showing another example of the joint structure.

FIG. 10 shows a modification of the above-mentioned L-shaped elastomeric insert 8 which can adopt to improve working efficiency by facilitating temporarily fix.

In this case, the elastomeric insert 8 comprises the above-mentioned main portion 8A and a perpendicular portion 8B and further a fixing portion 8C protruding towards the other side of the main portion 8A from the portion 8B to have a T-shaped cross sectional shape. To adapt thereto, the overhang 24 of the FRP component M2 is modified such that the above-mentioned step 24's surface 24*t* at the rear end of the overhang 24 is provided with a groove 36 into which the fixing portion 8C is inserted.

Figure 11:
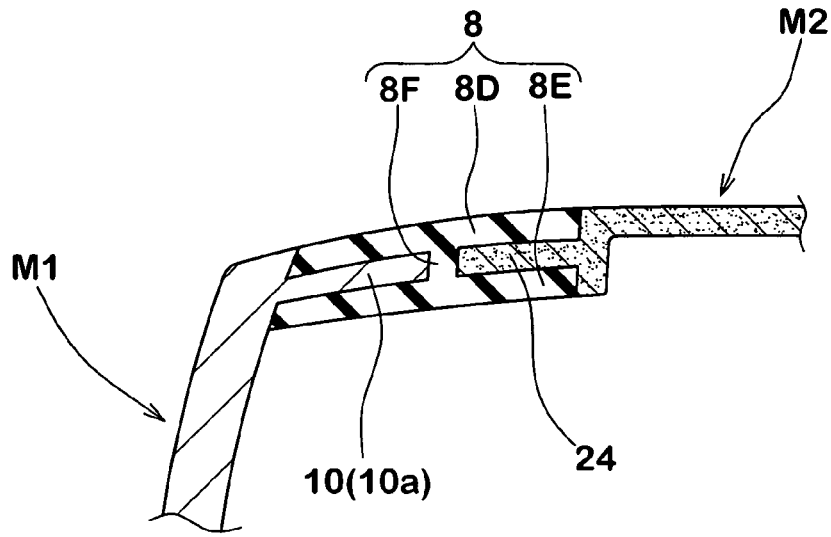

FIG. 11 shows another example of the joint portion between the turnback 10 and the overhang 24 and an elastomeric insert 8 therefor. The elastomeric insert 8 is compose d of an outside portion 8D, an inside portion 8E and a bridge portion 8F extending therebetween to have a H-shaped cross sectional shape. The turnback 10(10*a*) and overhang 24 recede from the outer surface of the club head, and the turnback and overhang are inserted into the resultant slits between the outside portion 8D and inside portion 8E. When inserted, the outside portion 8D becomes flush with the outer surface of the head 1, namely, the thicknesses and the amount of receding are so determined. In this example, as the elastomeric insert 8 has a high proportion of the surface area, by using a colored material it may be possible to provide an attractive appearance for the head.

Figure 12:
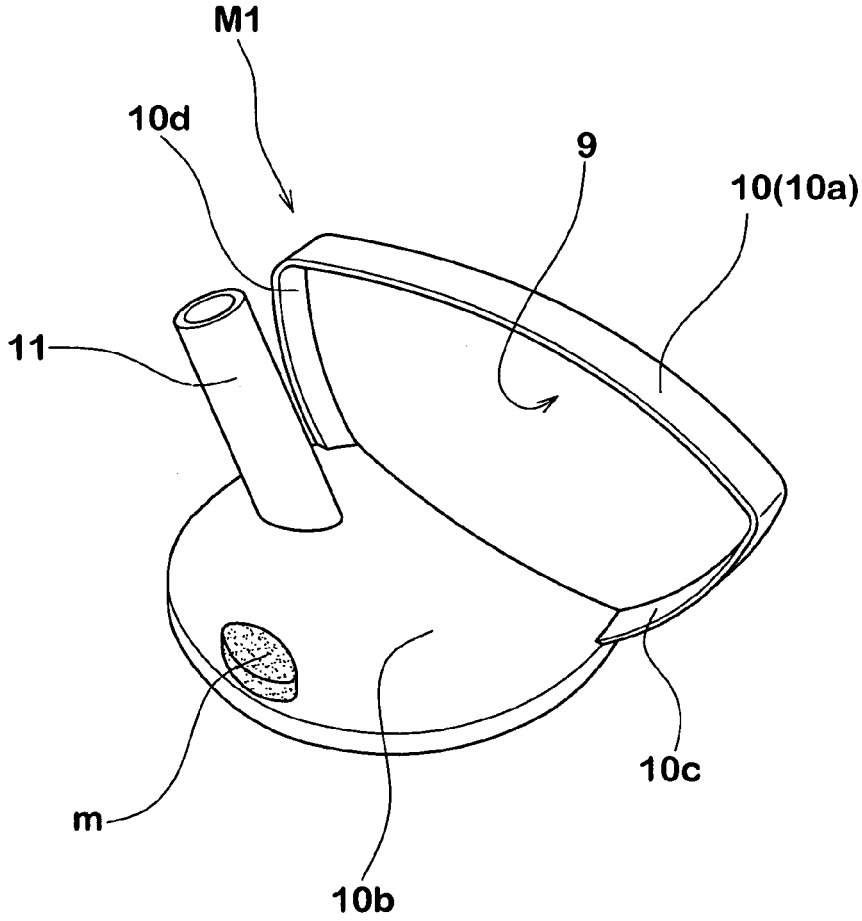
FIGS. 12, 13 and 14 are perspective views each showing another example of the face component.

In order to lower and deepen the center of gravity, as shown in FIG. 12, a weight (m) made of a metal having a large specific gravity for example, tungsten, lead and the like may be fixed to the lower turnback 10*b* of the face component M1 instead of the gradual increasing of the thickness of the lower turnback 10*b*.

Figure 13:
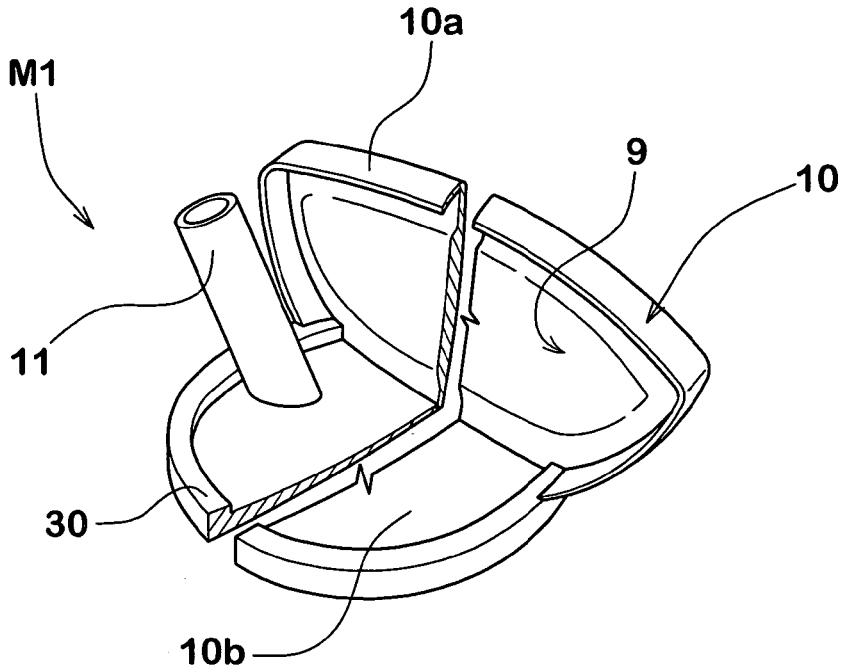

FIG. 13 shows another example of the face component M1 designed to increase the moment of inertia of the head while achieving further lowering of the center of gravity at the same time, wherein the lower turnback 10*b* is formed as being thicker in the peripheral zone than the central zone by providing a rib 30. In FIG. 13, the rib 30 is formed continuously along the entire length of the edge of the lower turnback 10*b* which is gradually increased in the thickness in the central zone in the same way as in the former example shown in FIG. 6. But, the thickness in the central zone may be substantially constant as shown in the next example.

Figure 14:
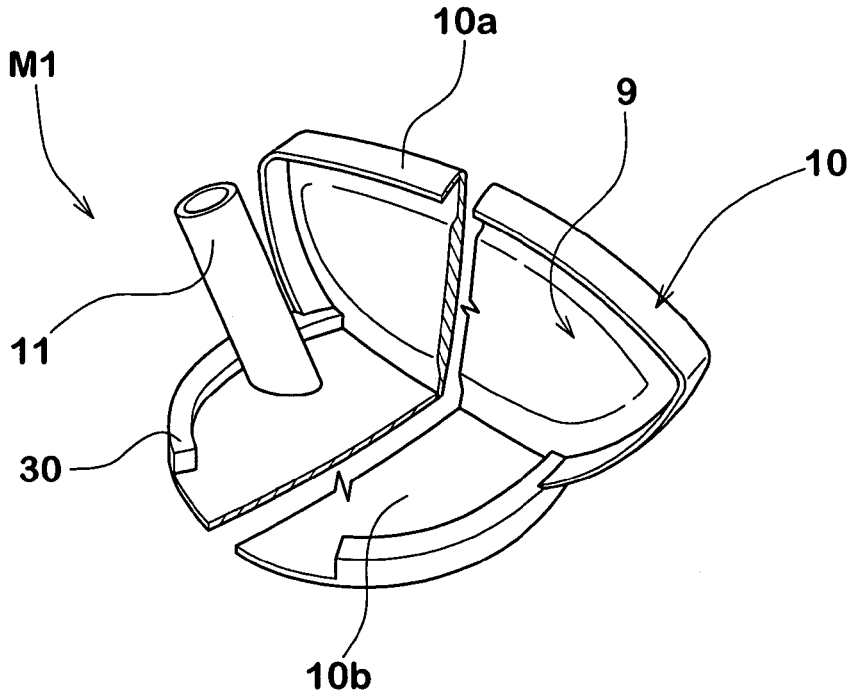

In FIG. 14, the rib 30 is formed discontinuously on the toe side and heel side along the edge of the lower turnback 10*b*, and the thickness in the central zone is substantially constant. But, the thickness in the central zone may be gradually changed as shown in the former example in FIG. 13.

Comparison Tests

Wood-type golf club heads having the same outer shapes shown in FIG. 1 and specifications shown in Table 2 were made and tested for the hitting sound, durability and traveling distance of the ball.

The face components were manufactured using titanium alloys (Ti-15V-6Cr-4Al), (Ti-4.5Al-3V-2Mo-2Fe) and (Ti-6Al-4V). The FRP component was manufactured, using prepreg pieces, a bladder and a mold as explained above. Carbon fibers used were "TR50S", "MR40" and "HR40" shown in Table 1.

Firstly, the elastomeric insert was bonded to the FRP component, using epoxy adhesive "Araldite (AW106/HV953U)" Ciba-Geigy Japan Ltd. The thickness of the applied epoxy adhesive was about 0.5 to 1.0 mm. Then, the face component and the FRP component with the elastomeric insert were bonded using the adhesive.

Figure 16:
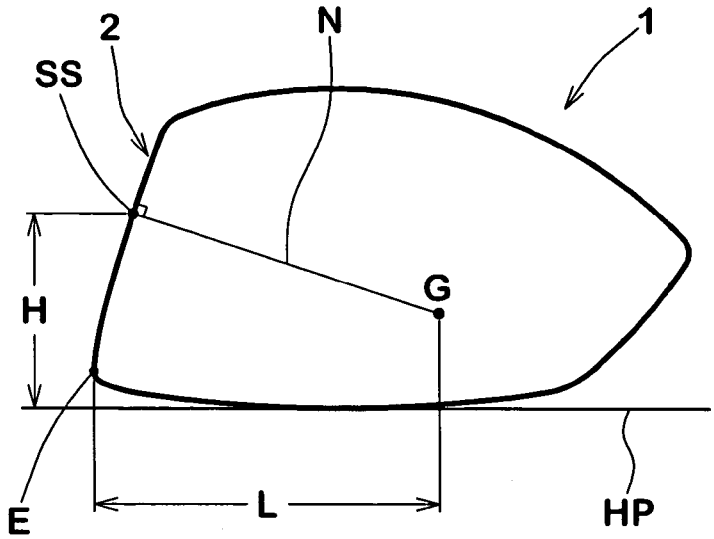
FIG. 16 is a simplified cross sectional view taken along line A-A in FIG. 2 to explain the depth of the center of gravity and the height of the sweet spot.

Also the depth L of the center of gravity G and the height H of the sweet spot SS were measured. Here, the depth L is the horizontal distance of the center of gravity G of the club head from the leading edge E of the head measured in the back and force direction under the measuring state. The measuring state is as shown in FIG. 16, a state of the golf club head 1 which is put on a horizontal plane HP such that the club shaft center line CL (the center line of the hosel) is inclined at the lie angle while keeping the center line CL on a vertical plane, and the club face 2 forms its loft angle with respect to the horizontal plane HP. The sweet spot height H is the vertical height of the sweet spot SS from the horizontal plane HP, wherein the sweet spot SS is the point of intersection between the club face 2 and a straight line N drawn normally to the club face 2 from the center of gravity G.

Ball Traveling Distance Test

The club heads were attached to identical carbon shafts to make 46-inch wood clubs. Each club was mounted on a swing robot, and three-piece balls (MAXFLI HI-BRID, Sumitomo Rubber Ind., Ltd.) were struck at a head speed of 45 m/s five times at the sweet spot to obtain the mean traveling distance (carry plus run). The results are shown in Table 2.

Hitting Sound Test (Feeling Test)

With those wood clubs, fifty average golfers having handicaps ranging from 15 to 25 struck the golf balls, and by the golfers' feeling the hitting sound was evaluated into five ranks from a point of view of whether the hitting sound was a favorable high-pitched sound. The higher the rank number, the more the favorable high-pitched sound.

Hitting Sound Test (Frequency Analysis)

Again using the swing robot instead of the golfers, the golf balls were hit at the sweet spot of each of the clubs five times at a head speed of 40 m/s, and the hitting sound was measured with a microphone fixed at a height of 160 cm and a distance of 80 cm sideways from the ball position.

The frequency spectrum of the measured hitting sound was analyzed at ⅓ octave band resolution to find out ten ⅓-octave-bands showing the largest ten sound pressure levels, and the mean value of the center frequencies of those ⅓-octave-bands was calculated. Such mean values are shown in Table 2, wherein the larger the value, the higher the frequency.

Durability Test

Using the swing robot, the club head struck the golf balls at the sweet spot 3000 times at a head speed of 51 meter/second, and thereafter the club face was checked for deformation and/or damage. The results shown are Table 2, wherein: "A" indicates that there was no damage; "B" indicates that damage occured between 3000 times and 2000 times; and "C" indicates that damage occured at less than 2000 times.

TABLE 2

| Club head | Ref. 1 | Ref. 2 | Ref. 3 | Ex. 1 | Ex. 2 | Ex. 3 | Ex. 4 | Ref. 4 |
|---|---|---|---|---|---|---|---|---|
| Head volume (cc) | 380 | 380 | 380 | 380 | 400 | 380 | 300 | 380 |
| Structure | FIG. 5 no-turnback | all-metal | all-CFRP | FIG. 5 | FIG. 5 | FIG. 5 | FIG. 5 | FIG. 5 |

TABLE 2-continued

Figure 18:
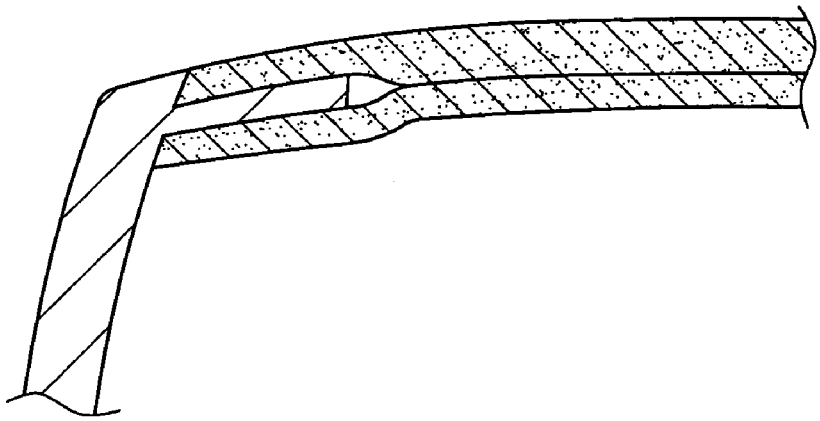
FIG. 18 and FIG. 19 are enlarged cross sectional views each showing the joint structure in Ref.1 and Ref.2, respectively, used in the undermentioned comparison tests.
Figure 19:
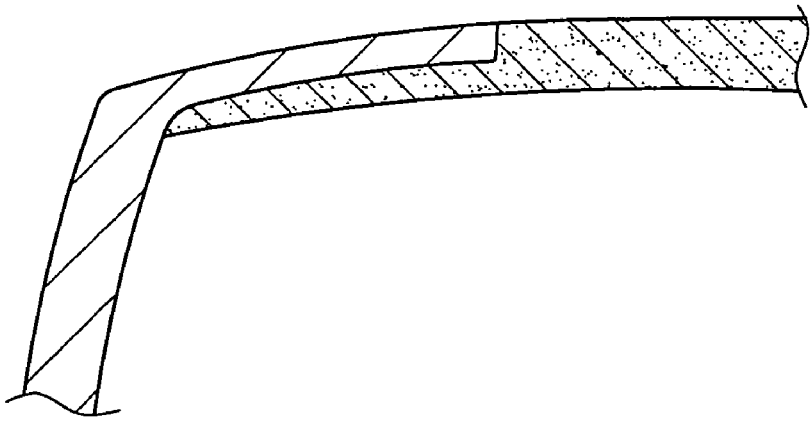

| Club head | | Ref. 1 | Ref. 2 | Ref. 3 | Ex. 1 | Ex. 2 | Ex. 3 | Ex. 4 | Ref. 4 |
|---|---|---|---|---|---|---|---|---|---|
| Hollow | | void | void | filled with expanded plastic | void | void | void | void | void |
| Material | | *1 | *1 | — | *1 | *1 | *2 | *3 | *1 |
| Face component | | | | | | | | | |
| Face plate thickness | central region Tc (mm) | 2.8 | 2.8 | 2.8 | 2.8 | 2.8 | 2.8 | 2.8 | 2.8 |
| | peripheral zone Tp (mm) | 2.0 | 2.0 | 2.0 | 2.0 | 2.0 | 2.0 | 2.0 | 2.0 |
| Upper turnback | Lc (mm) | none | 8 | 12 | 12 | 14 | 10 | 12 | 12 |
| | thickness (mm) | | 2.0 | 2.0 | 2.0 | 2.0 | 2.0 | 2.0 | 2.0 |
| Toe-side turnback | Lt (mm) | none | 4 | 12 | 12 | 12 | 10 | 12 | 12 |
| | thickness (mm) | | 2.0 | 2.0 | 2.0 | 2.0 | 2.0 | 2.0 | 2.0 |
| Heel-side turnback | Lh (mm) | none | 4 | 12 | 12 | 12 | 10 | 12 | 12 |
| | thickness (mm) | | 2.0 | 2.0 | 2.0 | 2.0 | 2.0 | 2.0 | 2.0 |
| Lower turnback | Ls (mm) | none | 60 | 65 | 65 | 70 | 65 | 55 | 65 |
| FRP component thickness | | | | | | | | | |
| Crown portion (mm) | | 0.8 | 0.8 | 0.8 | 0.8 | 0.8 | 0.8 | 0.8 | 0.8 |
| Side portion (mm) | | 1.7 | 1.7 | 1.7 | 1.7 | 1.7 | 1.7 | 1.7 | 1.7 |
| Junction | | FIG. 18 | FIG. 19 | FIG. 9 | FIG. 9 | FIG. 9 | FIG. 9 | FIG. 9 | FIG. 9 |
| Elastomeric insert | | | | | | | | | |
| Shore-A hardness | | 50 | 90 | 50 | 50 | 70 | 60 | 60 | — |
| Thickness | | 1 | 2 | 1.2 | 1.2 | 1.2 | 1.5 | 2 | — |
| Sweet spot height (mm) | | 21 | 33 | 30 | 22 | 24 | 22 | 35 | 23 |
| Depth of center of gravity (mm) | | 48 | 33 | 33 | 45 | 44 | 45 | 30 | 44 |
| Travering distance (yard) | | 242 | 220 | 200 | 242 | 245 | 241 | 210 | 200 |
| Backspin (rpm) | | 2305 | 2507 | 2700 | 2252 | 2253 | 2251 | 2251 | 2251 |
| Launching angle (deg.) | | 14.2 | 13 | 12.7 | 14 | 13.8 | 14 | 12.5 | 11 |
| Durability | | C | A | C | A | A | A | B | C |
| Hitting sound | | | | | | | | | |
| feeling | | 4 | 4 | 1 | 5 | 5 | 4 | 4 | 3 |
| frequency analysis (Hz) | | 6000 | 6000 | 3000 | 6500 | 6500 | 6200 | 6100 | 5000 |

*1: Face plate: Ti—15V—6Cr—4Al ("DAT55G", Daido Steel Co., Ltd.) Else: Ti—6Al—4V
*2: Face plate: Ti—4.5Al—3V—2Mo—2Fe ("SP700", Daido Steel Co., Ltd.) Else: Ti—6Al—4V
*3: Face plate and neck portion: Ti—6Al—4V Else: CFRP From the test results, it was confirmed that a high-pitched hitting sound can be obtained together with increased traveling distance at the same time while maintaining the necessary durability. Furthermore, it was also confirmed that, when compared with the bonding surface not roughened in all the turnback, even by roughening the upper turnback only, the durability of the junction between the face component and FRP component against the impact force can be increased about 20% in case of the above-mentioned club head Ex. 1.

The present invention is suitably applied to wood-type hollow club heads for driver, fairway wood and the like, but in addition thereto, it may be applied to other-types of club heads such as utility-type, iron-type, patter-type club heads as far as the head has a hollow immediately behind the face portion comprising the metal face component M1 and FRP component M2.

The invention claimed is:

1. A hollow golf club head comprising a face portion having a front face which defines a club face;

a sole portion, a hollow disposed behind the face portion;

a face component made of a metal material and including a face plate forming the face portion, and a turnback extending backward from the face plate;

a FRP component made of a fiber reinforced resin to which the face component is attached; and an elastomeric insert made of an elastomeric material disposed between the turnback and the FRP component, wherein said turnback is formed continuously around the face plate so as to form an upper turnback, a toe-side turnback, a heel-side turnback and a lower turnback, and the lower turnback forms the sole portion, said elastomeric insert has a certain length between the ends thereof so as to extend along the upper turnback, toe-side turnback and heel-side turnback, and the face component is integrally provided with a hosel tubular portion extending from the lower turnback, while leaving space between the hosel tubular portion and the face plate, wherein the FRP component is provided at the front thereof with an overhang, and the elastomeric insert is provided at the front thereof with a slit into which the upper, toe-side and heel-side turnbacks are inserted, and further the elastomeric insert is provided at the back thereof with a slit into which the overhang is inserted.

2. A hollow golf club head comprising a face portion having a front face which defines a club face;

a sole portion a hollow disposed behind the face portion;

a face component made of a metal material and including a face plate forming at least a part of the face portion, and a turnback extending backward from the face plate;

a FRP component made of a fiber reinforced resin to which the face component is attached; and an elastomeric insert made of an elastomeric material disposed between the turnback and the FRP component, wherein said turnback is formed continuously around the face plate so as to form an upper turnback, a toe-side turnback, a heel-side turnback and a lower turnback, and the lower turnback forms the sole portion, said elastomeric insert has a certain length between the ends thereof so as to extend along the upper turnback, toe-side turnback and heel-side turnback, the face component is integrally provided with a hosel tubular portion extending from the lower turnback, while defining a space between the hosel tubular portion and the face plate, the depth of the center of gravity of the golf club head is in the range of from 40 to 55 mm and the height of the sweet spot is in the range of from 15 to 30 mm, wherein the FRP component is provided at the front thereof with an overhang, and the elastomeric insert is provided at the front thereof with a slit into which the upper, toe-side and heel-side tumbacks are inserted, and further the elastomeric insert is provided at the back thereof with a slit into which the overhang is inserted.

* * * * *